United States Patent [19]

Baustin

[11] 4,420,083

[45] Dec. 13, 1983

[54] PILL BOTTLES

[76] Inventor: Michel M. Baustin, 1066 E. 81st St., Brooklyn, N.Y. 11236

[21] Appl. No.: 380,420

[22] Filed: May 20, 1982

Related U.S. Application Data

[63] Continuation of Ser. No. 243,885, Mar. 16, 1981, abandoned.

[51] Int. Cl.[3] ..... B65D 83/04; B65D 85/42

[52] U.S. Cl. ..... 206/538; 206/540; 220/22; 220/22.1

[58] Field of Search ..... 220/20, 22, 22.1; 206/540, 538, 539, 533, 526

[56] References Cited

U.S. PATENT DOCUMENTS

| | | | |
|---|---|---|---|
| 392,942 | 11/1888 | Anger | 220/20 |
| 2,220,190 | 11/1940 | Wolf | 220/20 |
| 2,335,016 | 11/1943 | Lorenzen et al. | 220/22 |
| 2,693,686 | 11/1954 | Pierce | 220/22 |
| 3,381,875 | 5/1968 | Tunick | 220/22 |
| 4,277,000 | 7/1981 | Jaarsma | 220/22 |

FOREIGN PATENT DOCUMENTS

| | | | |
|---|---|---|---|
| 1955464 | 5/1971 | Fed. Rep. of Germany | 220/22 |

*Primary Examiner*—Joseph Man-Fu Moy
*Attorney, Agent, or Firm*—William P. Keegan

[57] ABSTRACT

A pill bottle having a conventional closure is provided with a flexible member for dividing the interior of the bottle into two compartments, one for the total supply of pills and the other for the daily dosage of pills. Upon removal of the conventional closure, the flexible member can be deflected to cover the total supply of pills or, in other words, to close the total supply compartment so that when the bottle is inverted to dispense a pill, the pill can only fall from the daily dosage compartment.

3 Claims, 3 Drawing Figures

PILL BOTTLES

This application is a continuation of Ser. No. 243,885, filed Mar. 16, 1981, now abandoned.

FIELD OF THE INVENTION

The present invention relates to pill bottles or, more generally, to bottles or containers that hold a supply of medicinal pills or tablets that are to be ingested in a period of time usually extending over several days.

BACKGROUND OF THE INVENTION

It is well known that in dispensing prescriptive drugs or medicines in the pill or tablet form, a multi-day supply is furnished to a person with the instruction that a portion of the supply is to be taken each day until the total number of pills or tablets is exhausted. Thus, a prescription may call for twenty one units of a medicine to be ingested for seven days at the rate of three per day. The daily dosage is to be apportioned during a day, but it is less important that each dose be equally spaced from the others than that the total daily dosage be consumed during the day. This is so because it is most likely that a person will ingest only one pill at a time but lose count of the numbr of pills taken earlier in a day.

Thus, it becomes important to provide means to enable a person to assure that the proper dosage of a medicine is taken daily. This is especially true in the case of elderly persons who might tend to be forgetful, or who might simply become confused because of the need to ingest a number of different medicines from different containers or bottles each of which might have a different daily dosage requirement. In a simple case, a person might have to take three pills of one type per day and four pills of another type per day. It is readily apparent that during the course of a day there may be uncertainty as to whether three pills of one type were taken or three pills of the other type. This, in turn, could lead to underutilization of the pills to be taken four times per day and overutilization of the pills to be taken three times per day.

The problem here mentioned has been discussed in the past. For example, U.S. Pat. No. 3,675,620 disclosed means for recording when a medicine dose is ingested. U.S. Pat. No. 3,931,891 discloses a pill bottle having a pocket section into which a daily supply of pills can be placed after being separated from the total supply in the pill bottle.

BRIEF DESCRIPTION OF THE INVENTION

It is the object of the present invention to provide an improved medicine container that facilitates the ingestion of the proper daily dosage of the medicine.

In carrying out the invention there is provided a pill or table container having a member that divides the interior of the container into a supply compartment and a daily dosage compartment. The container is provided with the usual closure that closes both compartments so that the contents thereof cannot be dispensed while the closure is in place. The dividing member is itself capable of closing at least the total supply compartment so that compartment can be closed when a pill or tablet is dispensed from the other or daily dosage compartment.

Features and advantages of the invention will be gained from the foregoing and from the description of a preferred embodiment thereof which follows.

DETAILED DESCRIPTION OF THE INVENTION

Figure 1:
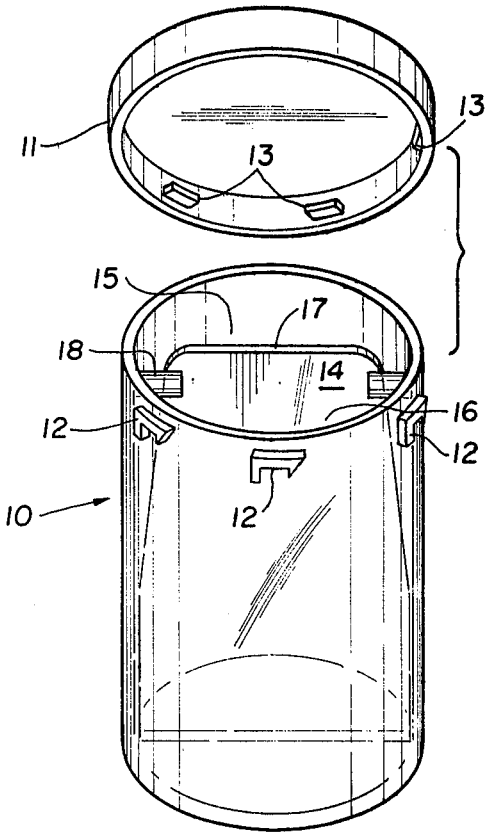
FIG. 1 is a perspective view of a pill bottle according to the present invention.

Referring to FIG. 1 of the drawing, the container 10 for carrying pills or tablets, hereinafter referred to as a pill bottle, is shown as a cylindrical member open at its top end. A closure 11 is provided for the usual purpose. Around the upper periphery of bottle 10 are a number of locking projections 12 that interact with corresponding lugs 13 provided on the interior surface of the sidewall of closure 11. Projections 12 and lugs 13 enable closure 11 to be placed on bottle 10 in a manner that makes it somewhat difficult to remove closure 11 from bottle 10. Thus, the bottle can be said to be resistant to opening by a child. Closure 11 disclosed forms no part of the present invention so its details and operational characteristics will not be described. Other child resistant closures or a simple screw cap or snap-on cap could be used in conjunction with bottle 10.

A flexible member 14 is provided within bottle 10 to divide the interior into two compartments, a total supply compartment 15 and a daily dosage compartment 16. The compartments need not be equal in size. Member 14 extends downwardly to the bottom wall of bottle 10 and upwardly to a position ajdacent the inner surface of closure 11 when the latter is placed on the bottle. The top and bottom edges of member 14 need not actually contact closure 11 and the bottom wall of bottle 10, but they should be proximate thereto so that a pill or tablet held in bottle 10 cannot pass from one compartment 15 or 16 to the other above or below the edges being considered.

The flexibility of member 14 should be such that the top edge 17 thereof can be deflected towards the sidewall of bottle 10, either to contact the sidewall or be close enough thereto so that a pill or tablet cannot pass around the side edges of member 14. Since member 14 will most likely be used in a cylindrical bottle 10, the side edges of member 14 will be tapered inwardly from the bottom to the top to allow the member to be deflected towards the sidewall of bottle 10. When member 14 is aigned vertically in bottle 10, the spacing between its side edges and the sidewall of bottle 10 will be small enough to prevent a pill or tablet passing around a side edge from one compartment to the other.

Member 14 may be molded as an integral part of bottle 10, or it may be a separate piece that is secured within the bottle either adhesively or simply by frictional engagement at its lower end with the sidewall of the bottle. In the latter case, the lower portion of the side edge of members 14 may be straight to conform to the inner surface of bottle 10 and the remainder of the side edges tapered as above indicated.

Figure 2:
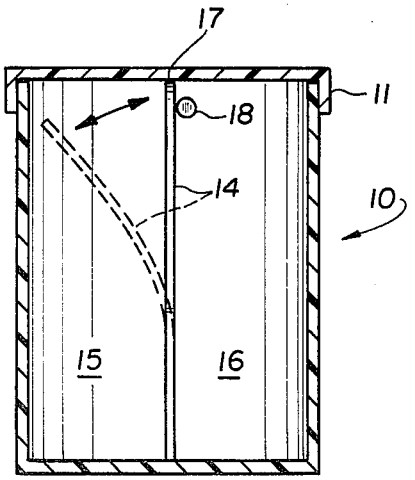
FIG. 2 is a side elevational view, partly in section of the pill bottle of FIG. 1.
Figure 3:
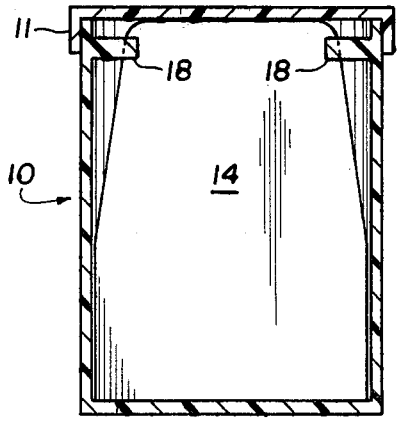
FIG. 3 is a front elevational view, partly in section, of the pill bottle of FIG. 1.

In use, bottle 10 will be filled with a total supply of pills or tablets which are all placed in compartment 15. With closure 11 in place no pill or tablet can pass member 14 to move into compartment 16 no matter how bottle 10 is shaken or turned. Now, a person will remove closure 11 from bottle 10 and spill a number of pills or tablets equal to the daily dosage requirement into his hand. The person next will deflect member 14 to cover the pills or tablets remaining in compartment 15 and drop the daily dosage number of pills or tablets into compartment 16. Member 14 is released whereupon it returns to the position shown in FIG. 2 and closure 11 is secured to bottle 10. The pills or tablets will remain in the compartments into which they were placed with no possibility of a pill or tablet transferring from one compartment to the other if the bottle is turned or inverted or otherwise agitated. When a pill or tablet is to be taken, closure 11 is removed, the person's index finger used to deflect member 14 over the total supply of pills and, in effect, close compartment 15 whereupon bottle 10 can be inverted to spill a pill or tablet from daily dosage compartment 16. If compartment 15 is not closed, as with member 14, inversion of bottle 10 to spill a pill or tablet from daily dosage compartment 16 could dispense a pill from total supply compartment 15. Thus, it is to understood that member 14 not only separates a daily dosage number of pills or tablets from the total supply of pills or tablets, but also, and more importantly, serves as a closure for the compartment holding the total supply of pills or tablets.

Since, as mentioned, member 14 is intended to act as a closure for compartment 15 to prevent the accidental dispensing of a pill or tablet from the total supply of pills, a pair of stops 18 could be provided so that member 14 can be flexed in one direction only, that is, to close compartment 15. This is particularly advantageous since it assures that a person, after placing a daily dosage of pills or tablets into compartment 16, cannot close compartment 16 with member 14 and take a pill or tablet from compartment 15 under the impression that he is doing the reverse.

Mechanical arrangements for performing the aforesaid functions could be provided as well as flexible member 14. For example, a rigid divider member, integrally molded to the interior of bottle 10, could divide the interior into compartments 15 and 16. A rotatable closure disk (in addition to closure 11) having an opening large enough to uncover either compartment 15 or 16, but not both at once, could be fitted to the top of bottle 10. In use, after removal of main closure 11 and closure disk would be rotated so that its opening uncovered total supply compartment 15 to permit the removal therefrom of the daily dosage number of pills or tablets. The disk would then be rotated so that its opening gave access to the daily dosage compartment 16 and the daily dosage number of pills or tablets placed in that compartment. The closure disk would be left in that position and the main closure 11 placed on bottle 10. When a pill or tablet is to be taken, closure 11 would be removed and bottle 10 inverted. Since the opening in the closure disk is aligned with daily dosage compartment 16, a pill or tablet from that compartment only would be dispensed.

Having thus described the invention it is clear that what may appear to be different embodiments could be provided without departing from the spirit and scope of the invention. Hence it is intended that the foregoing specification and the accompanying drawing be interpreted as illustrative rather than in a limiting sense.

What is claimed is:

1. A pill bottle adapted to facilitate dispensing the proper daily dosage of pills from a total supply of pills in the bottle, said bottle comprising an open top container for holding a plurality of pills, removable closure means for closing the open top of said container, and flexible resilient means secured to the interior of said container adjacent the bottom thereof and extending substantially to the top of said container for dividing said container into two separate open ended pill compartments both of which are accessible when said closure means is removed, said flexible resilient means having edges slightly spaced from the container so that said means can be flexed to close one of said compartments, the spacing of the edges of said resilient means from said container and the top thereof being such that a pill cannot pass from one pill compartment to the other when said closure means is in place, said flexible resilient means being adapted, when flexed, to close one of said compartments and, when released, to return to its initial position to give access to both pill compartments, the arrangement being such that a total supply of pills can be placed in the one of said pill compartments which is closed upon flexure of said flexible resilient means and a daily dosage of the pills placed into the other of said pill compartments from which they are dispensed for use while the other compartment is closed by said flexible resilient means.

2. A pill bottle according to claim 1 wherein said flexible resilient means is a separate member that is frictionally held at its lower end in said container.

3. A pill bottle according to claim 1 including stop means to prevent said flexible resilient means being flexed to a position to close the daily dosage pill compartment.

* * * * *